United States Patent [19]

Kleefeldt et al.

[11] 4,135,377

[45] Jan. 23, 1979

[54] CENTRAL LOCKING EQUIPMENT FOR VEHICLE DOORS

[75] Inventors: Frank Kleefeldt; Lothar Krause, both of Heiligenhaus, Fed. Rep. of Germany

[73] Assignee: Arn. Kiekert Sohne, Heiligenhaus, Fed. Rep. of Germany

[21] Appl. No.: 746,222

[22] Filed: Nov. 30, 1976

[30] Foreign Application Priority Data

Dec. 1, 1975 [DE] Fed. Rep. of Germany ..... 2553901
Mar. 31, 1976 [DE] Fed. Rep. of Germany ..... 2613681

[51] Int. Cl.[2] ..... E05B 47/02; E05B 65/36

[52] U.S. Cl. ..... 70/264; 70/279; 70/280; 70/465; 292/144; 292/201

[58] Field of Search ..... 70/262–264, 70/277, 279, 283, 237, 257, 465, 218, 222, 223; 292/144, 201; 180/112, 113; 192/56 L

[56] References Cited

U.S. PATENT DOCUMENTS

| | | | |
|---|---|---|---|
| 2,212,252 | 8/1940 | Srodulski | 192/56 L |
| 2,827,321 | 3/1958 | Leslie et al. | 70/262 X |
| 2,904,988 | 9/1959 | Gaida | 70/264 |
| 2,922,672 | 1/1960 | Van Voorhees | 70/262 X |
| 3,030,794 | 4/1962 | Dyer et al. | 70/264 |
| 3,431,998 | 3/1969 | Martin | 180/112 |
| 3,435,645 | 4/1969 | Gallo | 70/263 X |
| 3,548,619 | 12/1970 | Purdy | 70/279 X |
| 3,612,207 | 10/1971 | Cabanes et al. | 70/264 X |
| 3,653,237 | 4/1972 | DuRocher | 70/264 |
| 3,947,060 | 3/1976 | Zimmer et al. | 70/279 X |

FOREIGN PATENT DOCUMENTS

| | | | |
|---|---|---|---|
| 2239766 | 3/1973 | Fed. Rep. of Germany | 70/237 R |
| 1168389 | 10/1969 | United Kingdom | 192/56 L |
| 1190327 | 5/1970 | United Kingdom | 70/264 |

*Primary Examiner*—Rodney H. Bonck
*Attorney, Agent, or Firm*—Smyth, Pavitt, Siegemund, Jones & Martella

[57] ABSTRACT

A system for locking the doors of a vehicle by central command includes a reversible motor driving a worm gear. A traveling nut operated by the worm gear engages a lock-actuating lever through an overload clutch. The overload clutch includes a cam and a cam follower. The cam has a normal central stable position bounded on either side by regions of neutral stability which permit override by small manually applied forces in case the motor or worm gear malfunctions. The system further includes a spring powered mechanism for unlocking the doors in the event of an accident. The spring powered mechanism is tripped electrically by an acceleration-sensing switch, and can be recocked by applying a relatively large force to a plunger located on the window sill.

10 Claims, 12 Drawing Figures

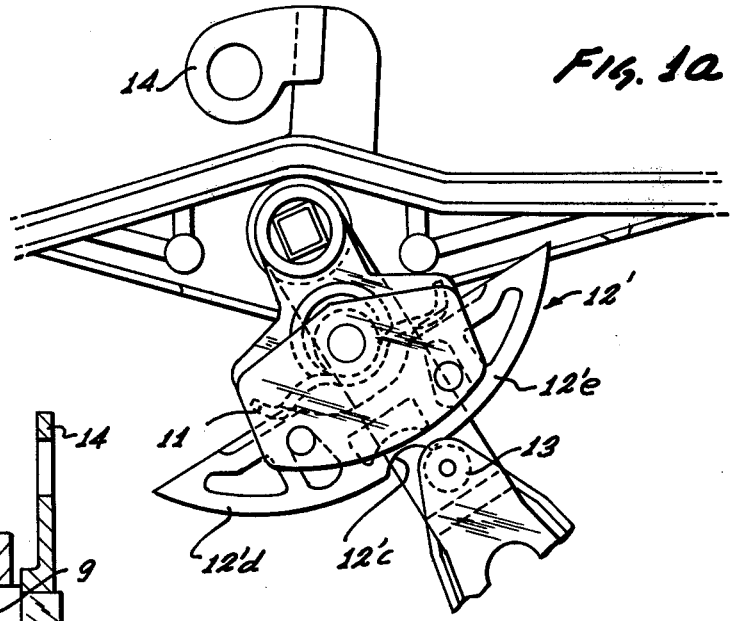
Fig. 1a
Fig. 2
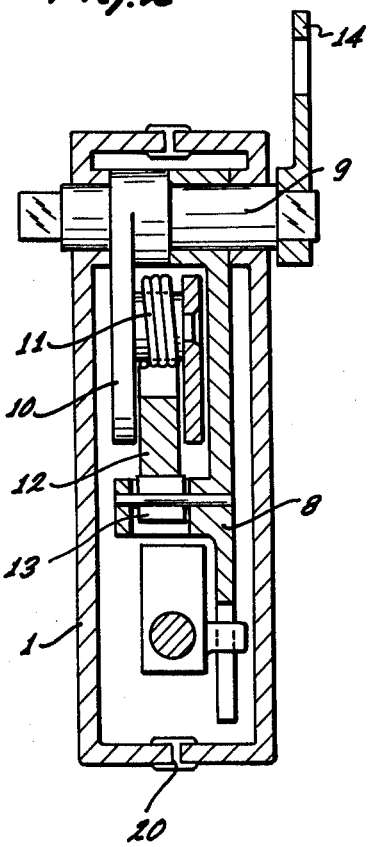
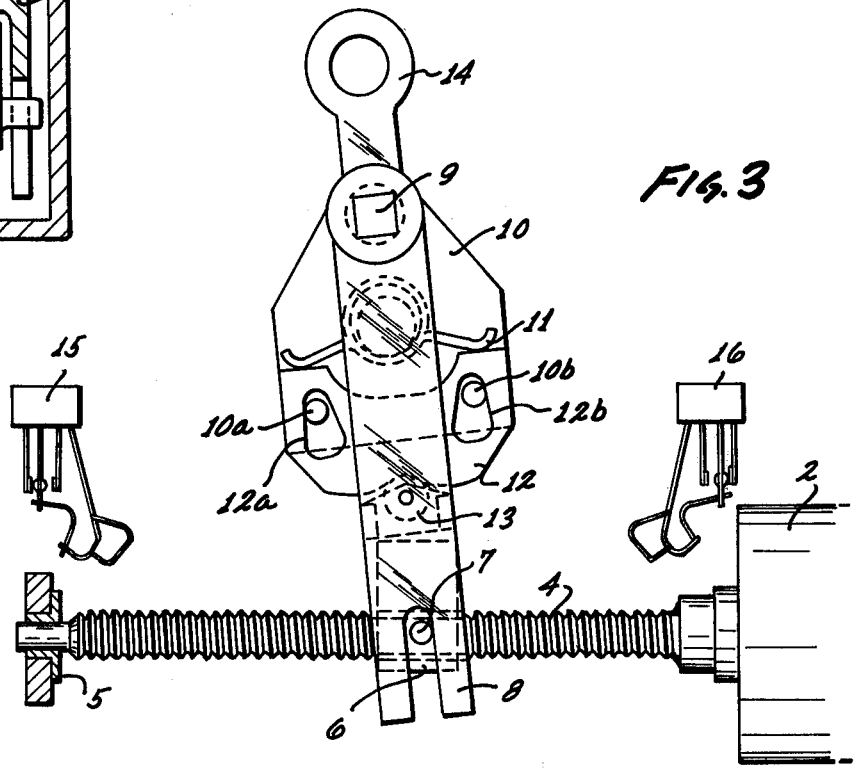
Fig. 3

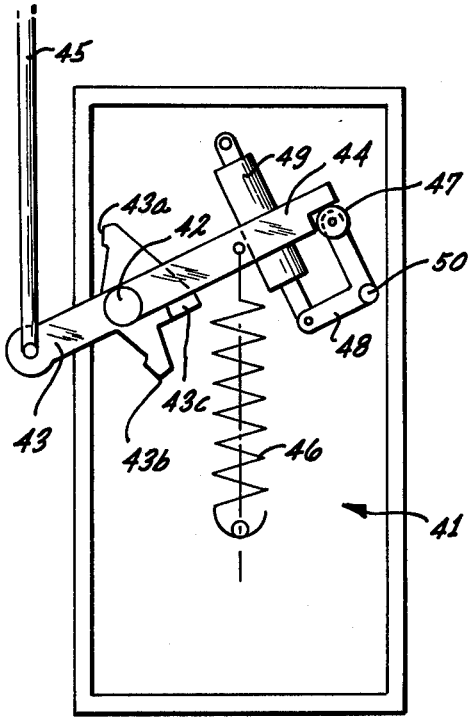
Fig. 9
Fig. 10
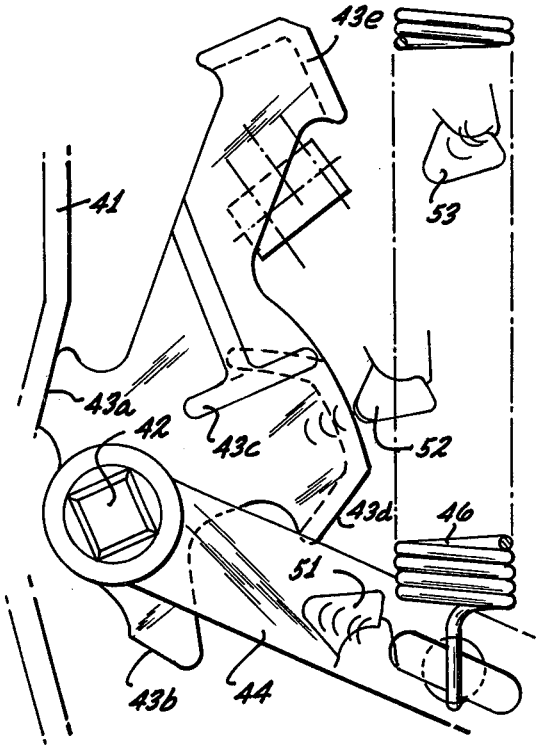
Fig. 11
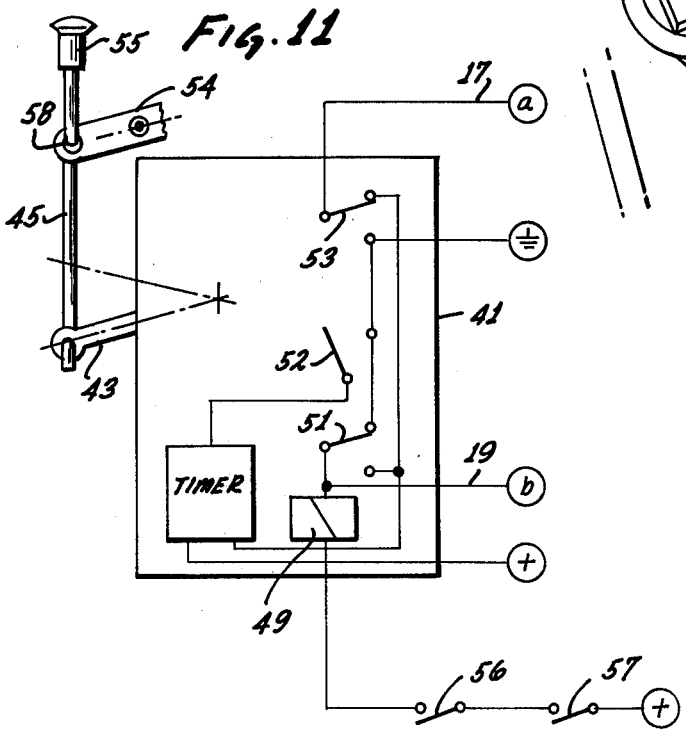

CENTRAL LOCKING EQUIPMENT FOR VEHICLE DOORS

BACKGROUND OF THE INVENTION

1. Field of the Invention

The invention relates to a central locking equipment for vehicle doors, provided with drive units for locking the individual doors. Each drive unit contains a reversible electromotor with reduction-gear which drives a locking linkage by means of a driven lever. The locking linkage can also be operated by hand.

2. The Prior Art

The German printed patent application No. P 19 55 239 discloses a servo-activated locking equipment for vehicle doors. That equipment contains several drive units with reversible electromotors. Each motor operates through a reduction gear and linkage on the locking lever of the lock. In addition, a linkage rod connects the lever with a locking button which is activated by hand. In the linkage between the drive unit and the lock, a control switching device is mounted in the front doors which reacts to tension or pressure to switch the motor into the left or right running mode, respectively. If, for example, the driver's door is locked from the outside, the closing motion exerts such a pressure on the control switching device that it makes contact and starts the motors of the drive units of the other doors. Therefore, all doors are locked simultaneously, and they are also unlocked when unlatched. Nevertheless, each door can be unlocked individually from the inside by lifting the respective locking button. Due to the mechanical coupling for the transmission and the motor of the corresponding drive, these elements are still on line during this procedure and are thus manually operated. Because the toothed segment and pinion of the transmission provide a large mechanical advantage, manual operation requires application of considerable force. A further disadvantage is presented by the complicated assembly and the inexact disengagement of the motor, which can cause failures.

SUMMARY OF THE INVENTION

It is an object of the present invention to simplify the structure of the known locking devices and to improve their functioning. Above all it is required that in case of failure of the automatic operation, locking can be accomplished by hand without great application of force.

It is a specific object of the present invention to improve on automatic locking devices for vehicle doors which typically include a reversible motor, a reduction gearing, and an actuator for coupling to the door lock.

In accordance with the preferred embodiment of the present invention it is suggested to provide a bilaterally effective, spring loaded overload clutch for selective coupling of the reduction gearing to the door lock actuator. Manual operation of the door lock has to overcome merely the spring bias to decouple the door lock actuator from the gearing, but energization of the motor will immediately effect recoupling to enable the locking device to follow commands of the operator. The main constructive feature resides in the use of a spring biased cam which selectively engages or disengages from a roller or a lever that is guided on a travelling unit which in turn rides on a worm gear constituting the reduction gearing as the preferred mode of for practicing the invention.

The invention system furthermore includes a mechanism that is acted upon by excessive acceleration or deceleration for automatically operating the door locks for unlocking them.

BRIEF DESCRIPTION OF THE DRAWINGS

FIG. 1*a* illustrates a modification of the cam used in the unit shown in FIG. 1;

FIG. 2 is a cross-section through the unit shown in FIG. 1;

FIG. 3 shows a detail of the drive in the unit in an intermediate position;

FIG. 9 is a somewhat schematic view of a new activator with emergency release;

FIG. 10 shows a section of a produced equipment; and

FIG. 11 represents the circuit diagram illustrating the principle of central operation.

DETAILED DESCRIPTION OF THE PREFERRED EMBODIMENT

Proceeding now to the detailed description of the drawings in which corresponding parts are denoted by the same reference symbol.

Figure 1:
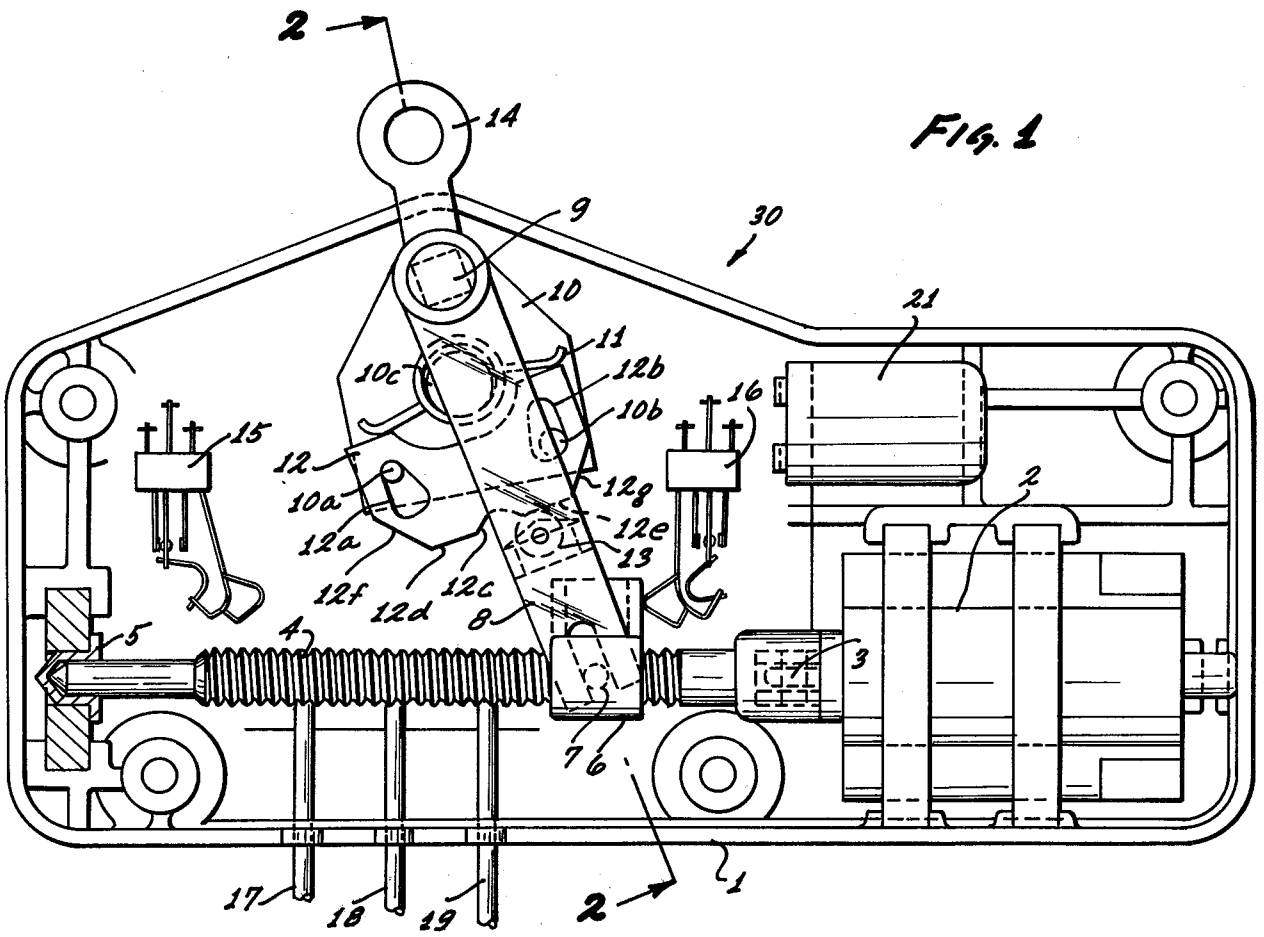
FIG. 1 is a side view of a unit in accordance with the preferred embodiment of the invention.

FIG. 1 shows a drive unit 30, including a case 1, being usually made of synthetic material and normally mounted inside of a door of a vehicle. A reversible motor 2 is mounted inside of the case. The shaft 3 of this motor drives a worm gear or spindle 4; gear 4 is mounted in bearings 5. On the spindle 4 runs a traveling nut 6 which engages a slotted, one-armed lever 8 via radial pins 7. This lever 8 is rotatably mounted on an axle 9.

A coupling plate 10 and a driven lever 14 are secured to axle 9. The leaver 14 has an eye which receives a pin **14*a* extending from a rod 32, shown in FIG. 8. The rod 32 can be actuated, i.e. longitudinally shifted manually to operate the lock 31. The coupling plate 10 carries pins 10*a*, 10*b*, and 10*c* as well as a bilateral spring 11. A cam track member and control disk 12 is provided with oblong holes 12*a*, 12*b* which respectively engage the pins 10*a*, 10*b*. The member 12 is pressed against a roller 13 by the lever spring 11 and the roller 13 is mounted on the lever 8**.

The parts 10-13 form a bilaterally acting overload coupling. When the roller 13 is resting in the depression **12*c* of the cam member 12, the coupling is engaged and the levers 8 and 14 are forced-locked. The coupling is able to transmit a certain torque determined by the strength of the lever spring 11. If this torque is exceeded to the right or to the left, the roller 13 moves from the depression 12*c* under deformation of the spring 11 and onto one of the two adjacent circular segments 12*d*, 12*e* of member 12. The active track contour of the latter is additionally provided with starting or run off slopes 12*f*, 12*g*. The roller 13, therefore, has either a stable, a neutral, or an unstable equilibrium position with respect to the cam disk and member 12, depending on whether the roller is respectively in the depression 12***c*, on a circular portion 12*d* or 12*e*, or on a run off slope 12*f* or 12*g*.

According to the illustration of FIG. 1, the drive has been turned off because the nut 6 has reached the extreme right position. In this position the levers 8 and 14 are actually disengaged from each other. Therefore, if a torque is applied by hand to the lever 14 in the clockwise direction, for instance, during a closing operation, the parts 14, 10 and 12 are easily rotated (rod 32 moving to the right). Consequently, this manual actuation requires substantially no effort to supply the necessary torque on the door key or the locking button. On the other hand, the motor 2 has to be strong enough to release and again engage the coupling obtaining automatic actuation of rod 32 via lever 14. The release from the illustrated position assumes that the lever 14 is held by the linkage rod 32 or by other stop devices. Now, the motor is turned on, turning drive shaft 4 so that the traveling nut 6 is running to the left. Shortly after commencement of this motion, the roller 13 drops into the depression 12*c* so that detent is effected and the lever 14 is thereafter driven in a clockwise direction.

Upon reaching its extreme left and right positions, the traveling nut 6 runs, respectively, against limit switches 15, 16 which turn off the current to the motor and, thereby prevent a thermal overload. The motor 2 is furthermore protected by a thermostat 21. The thermostat can be replaced by a timing unit, located in a central position, which interrupts the current sufficiently ahead of any excess heating.

The supply of electric current is provided by conductors 17, 18, 19. The circuit for the motor 2 is not shown in detail and is conventional. Suffice it to say that, for example, upon application of driving voltage to conductor 17 (18 being grounded) motor 2 turns in one direction as long as one of the limit switches 15, 16 are open. Closing of the latter interrupts the energizing circuit for the motor and prevents further energization in the same direction. Application of driving voltage to conductor 19 causes the motor to reverse until the other one of the switches 15, 16 interrupts that circuit.

FIG. 1*a* illustrates a modification of the cam member 12'. The circular segments 12'*d*, 12'*e* extend over the entire torsion angle of the disk, with exception of the stop location 12*c* in the center, so that run off slopes 12*f* and 12*g* of FIG. 1 are eliminated. This construction has the advantage over that of FIG. 1 that no resistance at the start has to be overcome, that is, the roller 13 does not have to be moved by increased force over any starting slope.

FIG. 2 illustrates a section through a part of the drive unit of FIG. 1. One recognizes distinctly the position of the lever spring 11 between the lever 8, the coupling plate 10 and the cam disk 12. As can be seen, the case 1 consists of two nearly identical parts which are united in such a way, that the included electrical parts are protected to a considerable degree against penetration of dust and spraywater. A seal 20 is provided at the junction between the halves of the case 1 to prevent the penetration of foreign particles. The entire drive unit is sufficiently compact — to be mounted without difficulty in any vehicle door.

Concerning the functioning and operational safety the following should be added. The motor 2 continues to drive the rod 32 until locking or unlocking has been accomplished, after which it is switched off again. In case of a blockage or other difficulty in turning of the lever 14, the clutch disengages the motor, thereby preventing the motor 2 from being stopped under stress and destroyed by a jammed lock or linkage. The second important function of the coupling consists in making the latching and unlatching of every door possible by hand.

Figure 4:
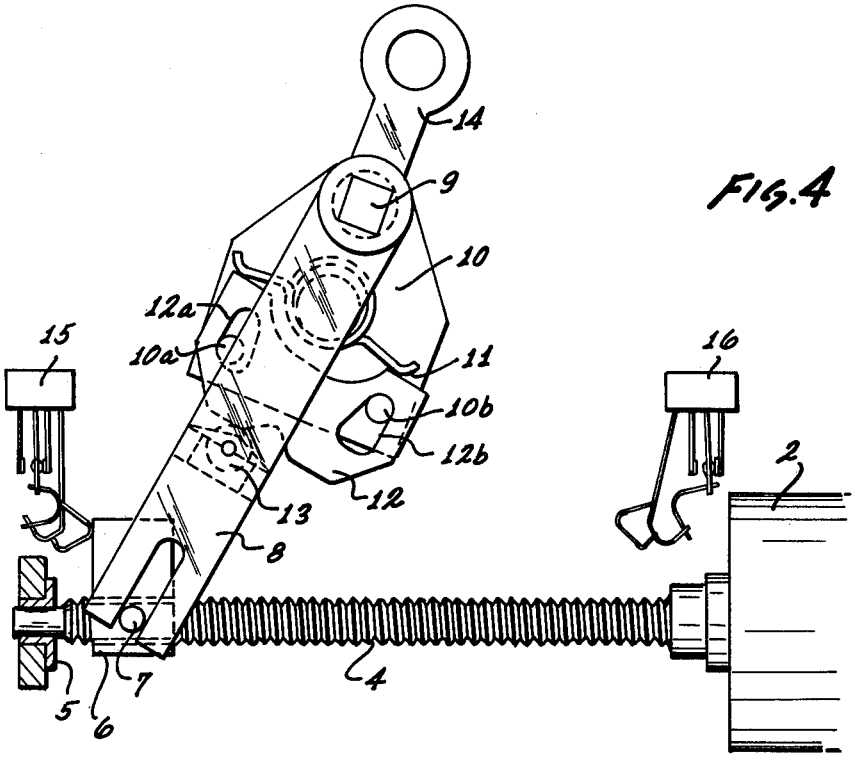
FIG. 4 is a similar view showing the drive in the unit in the extreme left position.
Figure 5:
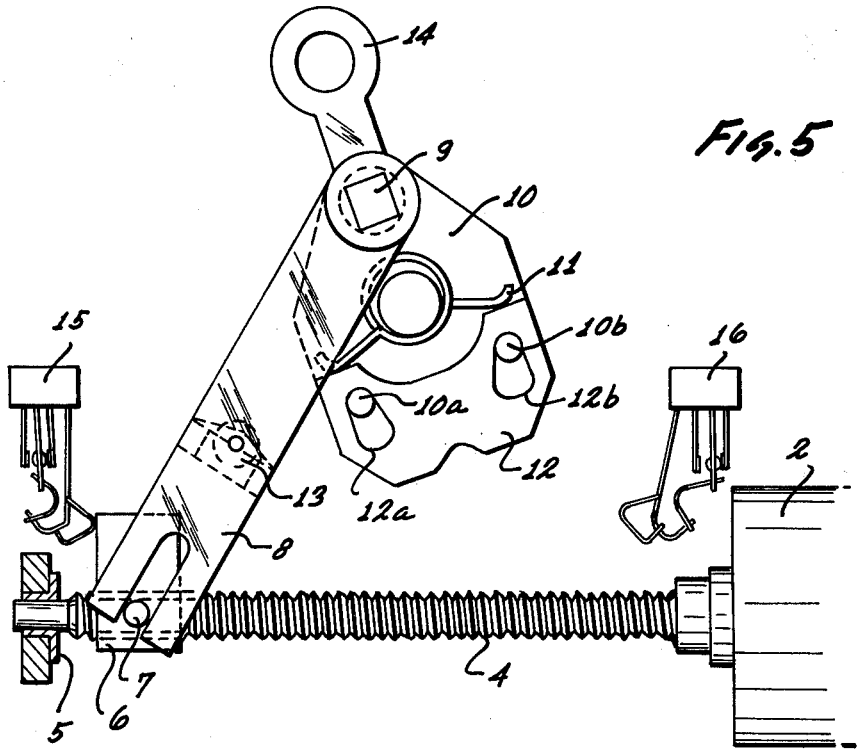
FIG. 5 is a similar view as FIG. 1 but in which the door lock has been displaced by hand.

FIG. 3 illustrates the drive in an intermediate position while levers 14 and 8 are coupled. The roller 13 rests in the depression 12*c* of the cam disk 12. This disposition is representative for movement of nut to the right or to the left. It should be noted that the pins 10*a*, 10*b* are disengaged from the slots 12*a*, 12*b* in the sense that they do not participate in the coupling action. In FIG. 4 the drive is shown in the extreme left position. The coupling is again disengaged following completion of an actuation step in which the nut 6 was driven to the left to move lever 14 and rod 32 into an alternative position. From this position the lever 14 can be shifted without use of force into the position shown in FIG. 5. This is done by activating the lock or the locking button by hand. The cam 12 is pushed by springs 11 into a central position and hangs, in fact, on pins 10*a*, 10*b*.

Figure 6:
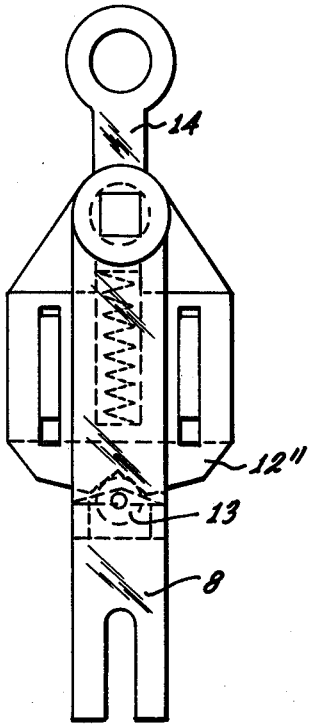
FIGS. 6 and 7 are elevations of the different constructions of a coupling that can be used in the unit.

The construction of the coupling is not limited to the illustrated design example. FIG. 6 shows an arrangement in which a cam plate 12'' is spring loaded to oppose sliding. Levers 8 and 14 are the same.

Figure 7:
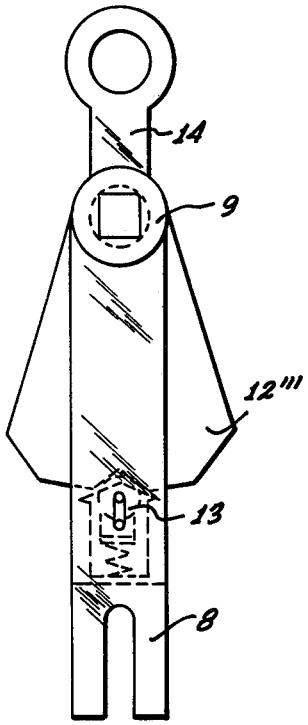

FIG. 7 represents a kinematical inversion. The cam 12''' rests directly and rigidly on the axle 9 while the roller 13 is spring loaded against the cam plate.

Figure 8:
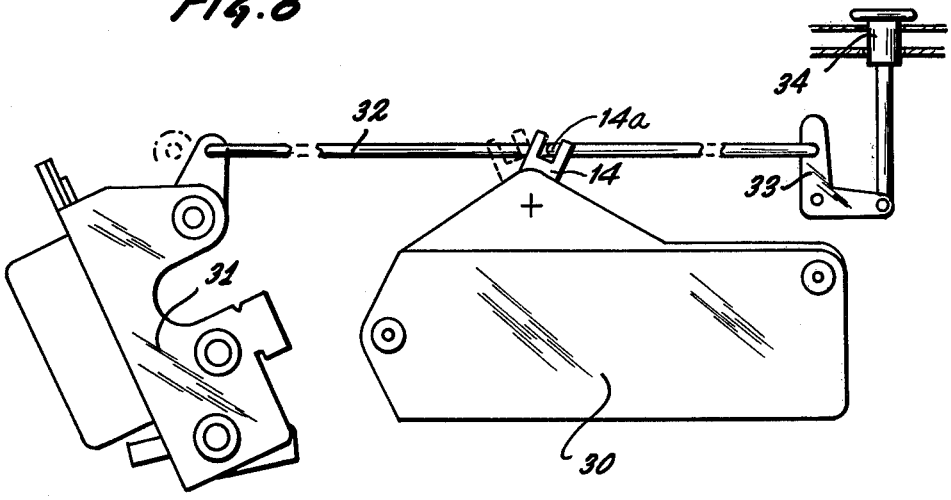
FIG. 8 illustrates the connection of the unit to a door lock and to the lock button.

In FIG. 8 the drive unit is indicated in its entirety by 30, and operates the door lock 31 coupled to locking linkage or rod 32. A crank 33 converts the movement of rod 32 into motion in the vertical direction. The crank 33 connects to the locking button 34 being shown in the depressed position, in which it practically rests on the window sill.

Centrally operated locking devices for car doors have the function, on one hand, to secure the vehicle with a minimum of manipulation, as well as to prevent an unententioned opening of the doors during the ride.

To assure complete safety, it is also necessary to provide an automatic emergency release, so that the doors can be opened without delay by rescuers in case of an accident.

Therefore, the inventive construction includes also an emergency release which requires little room and can be easily and securely operated.

As stated earlier, this additional feature is provided by the master activator of FIG. 9, which is located in the driver's door, provides an operating lever, connected through a springload, which activates the emergency release. The operating drive lever is locked by an electromagnet which has an accelerator switch in its electric circuit.

In FIG. 9 the master activator for the driver's door is indicated by 41. A shaft 42 is placed in the activator case and a connecting lever 43 is mounted on the shaft. A drive lever 44 is also mounted on shaft 42 for limited rotation a rod 45 is connected to the left end of a connecting lever 43 which is provided with end stops 43*a*, 43*b* as well as with follower arm 43*c* on which rests the drive lever 44. Attached to lever 44 is a tension spring 46 and a roller 47 which can be activated by an electromagnet 49 through a crank 48.

All parts are shown in FIG. 9 in the locked position for the doors. If the driver lifts the locking button and lever 45, the lock is released causing also lever 43 to be pivoted clockwise while lug or arm 43*c*, disengages from lever 44. The electromagnet 49 is connected with the power supply through an accelerator switch (not shown — see FIG. 11). In case an impact occurs while the doors are locked, the accelerator switch closes the electric circuit for the magnet 49 which attracts its armature. Thus, the crank 48 rotates clockwise around the axle 50, and the lever 44 is released. The spring 46 pulls the drive lever 44 clockwise and lever 44 engaging arm 43 forces the connecting lever 43 to follow that motion towards its opposite extreme position, in which the driver's door is unlocked. The unit 41 contains on a second plane electrical contacts which are controlled by the shaft 42. Thus, all the other drives of the other door release units are also controlled by the emergency release. They execute the release command, so long as the power supply is able to deliver sufficient current. If, for instance, the battery is damaged or the voltage interrupted due to a short circuit, sufficient energy is still available to release the driver's door a few milliseconds after the impact, so that the other doors can still be released from the driver's door.

If the described system has to be prepared again for operation after an emergency release, the spring 46 has to be stretched so that the roller 47 engages the lever 44. This is accomplished by depressing the locking button 55 with great force (for instance 4–6 kg) so that the rod 45 and the levers 43, 44 (counter clockwise) perform an overstroke and roller 47 can latch under lever 44.

Since the doorlock is normally not built to be able to follow the overstroke for the tension of the spring 46, an elastic spring element, preferably a rubber element 58, is provided in the linkage 45 between the master actuator 41 and the lock (not shown), which provides a tension of the spring 46 by means of an overstroke on the connecting lever 43 and the drive lever 44.

The described spring powered emergency release offers the great advantage that the electromagnet 49, which has only a release function, can be made very small and light. The actuator with its electrical contacts and emergency release equipment can easily be mounted in the cavities of the driver's door.

In FIG. 10 the master actuator is again indicated by 41. It contains the shaft 42. The connecting lever 43 has the cams 43*a*, 43*b*, 43*c* and the cam plates 43*d*, 43*e*, which operate the indicated switches 51, 52, 53. FIG. 11 shows the circuit diagram of the master unit 41. Among other features to be explained shortly, these switches 51, 52, 53 apply operating voltage to lines 17 and 19 as command signals by means of which the locking of the driver's door (position of button 55) controls the actuating motors in the other door units, to close their locks.

Unit 41 includes additionally the emergency feature as outlined. The connecting lever 43 is joined with the lock lever 54 and a safety button 55 through the linkage 45. Between the offset part of the linkage 45 and the lock lever 54, a rubber washer 58 is provided as an elastic link which makes the above mentioned overstroke possible. Outside the unit 41 is an accelerator switch 56. Reference number 57 represents the ignition switch.

If the ignition is turned on, normal vehicle operation holds the accelerator switch 56 in one of its two stable positions, i.e. the circuit is open. If acceleration sensing switch 56 responds, it closes and current flows from the positive pole of the battery through the coil of solenoid 49, and the switch 51 to ground. As soon as the coil triggers and reverses the lever 43, the switches 51, 52 and 53 are activated. The switch 51 then interrupts the electric circuit of the coil 49 so that it cannot be overloaded thermally, even if the accelerator switch 56 remains closed and the ignition is turned on.

The spring 46, which, instead of a coil spring, can also consist of a rubber spring or the like, is made strong enough to overcome all spring and friction forces in the doorlock and the linkage guides.

The main advantages of the invention consist in the fact that the new drive unit for locking does neither complicate the locking nor the unlocking by hand, that the driving motor cannot become stalled in an undefined intermediate position, and that even in case of a motor failure a control by hand is made possible.

The invention is not limited to the embodiments described above but all changes and modifications thereof not constituting departures from the spirit and scope of the invention are intended to be included.

We claim:

1. In a system for locking the doors of a vehicle by central command, wherein each door includes a unit which includes a reversible motor operable under the central command, and a manually operable doorlock actuator including a lever, the improvement in such a unit and for each of the units of the system comprising:
   - a worm gear spindle connected to be driven by the motor;
   - a traveling unit on the spindle and moving axially on the spindle as the spindle is driven by the motor;
   - a bilaterally effective spring loaded, overload clutch for selectively coupling and uncoupling the traveling unit to the lever of the doorlock actuator, the motor driving the lever via the spindle and the nut upon coupling of the nut to the lever by the clutch.

2. The system as in claim 1, further comprising a central unit having an actuating means operatively connected to at least one of the doorlock actuators of the system, the central unit further having a normally latched, spring biased drive lever, said actuating means being actuated by said drive lever, when unlatched; and emergency release electromagnet for unlatching biased drive lever, so that the spring bias causes the drive lever to operate the actuating means.

3. The central unit of claim 2, said actuator means being a connecting lever, said drive lever and said connecting lever being mounted on a common axle, said connecting lever having an arm which engages the drive lever by means of which the drive lever moves said actuator means, and by means of which said connecting lever, when operated by said doorlock operation causes the drive lever to be biased.

4. The system of claim 2, further comprising a linkage between said drive lever and the doorlock actuator and being constructed to latch the drive lever by overstroke on the connecting lever and the drive lever.

5. In a system for locking the doors of a vehicle by central command, wherein each door includes a unit which includes a reversible motor operable under the central command, and a reduction gearing connected to be driven by the motor, further including a manually operable doorlock actuator, the improvement in such a unit and for each of the units of the system comprising:
   - a bilaterally effective spring loaded, overload clutch which includes a resiliently biased cam member connected to said actuator, a lever coupled to the output side of the reduction gearing, and roller means on the lever for selective engagement with and disengagement from the cam member respectively for selectively coupling and uncoupling the reduction gearing respectively to and from the doorlock actuator.

6. The improvement of claim 5, wherein said cam member has two starting slopes and an intermediate recess for coupling engagement with said roller means.

7. The improvement of claim 5, further comprising spring means for urging the cam member into a stable position in relation to said actuator.

8. The improvement of claim 5, wherein said cam member has two oblong holes on said actuator for guidance.

9. The improvement of claim 5, wherein said cam member has two circular segments, and a coupling recess between the segments.

10. The improvement of claim 9, wherein said circular segments together cover a complete range of relative angular displacements of the roller means.

* * * * *